US010525327B2

(12) United States Patent
Chen

(10) Patent No.: US 10,525,327 B2
(45) Date of Patent: Jan. 7, 2020

(54) MODULAR RAMP SYSTEM

(71) Applicant: Wang-Chuan Chen, Taichung (TW)

(72) Inventor: Wang-Chuan Chen, Taichung (TW)

( * ) Notice: Subject to any disclaimer, the term of this patent is extended or adjusted under 35 U.S.C. 154(b) by 0 days.

(21) Appl. No.: 16/147,985

(22) Filed: Oct. 1, 2018

(65) Prior Publication Data

US 2019/0184266 A1 Jun. 20, 2019

Related U.S. Application Data

(63) Continuation-in-part of application No. 15/886,941, filed on Feb. 2, 2018, now Pat. No. 10,166,459.

(30) Foreign Application Priority Data

Dec. 15, 2017 (CN) ..... 2017 2 1763469

(51) Int. Cl.

| | |
|---|---|
| ***A63C 19/10*** | (2006.01) |
| ***E01C 13/00*** | (2006.01) |
| ***E01D 15/133*** | (2006.01) |

(52) U.S. Cl.

CPC ..... *A63C 19/10* (2013.01); *E01C 13/003* (2013.01); *E01D 15/133* (2013.01)

(58) Field of Classification Search

CPC .. A63C 19/02; A63C 2201/02; A63C 2230/10
See application file for complete search history.

(56) References Cited

U.S. PATENT DOCUMENTS

D256,713 S * 9/1980 Firestone ..... D21/817
8,196,244 B2 * 6/2012 Mapp ..... E01C 13/003 14/69.5
8,852,008 B2 10/2014 Chen

* cited by examiner

*Primary Examiner* — Michael D Dennis
(74) *Attorney, Agent, or Firm* — Alan D. Kamrath; Karin L. Williams; Mayer & Williams PC

(57) ABSTRACT

A modular ramp system includes a ramp component and a connector releasably joined to the ramp component. The ramp component has first and second inclined surfaces and a connecting portion positioned between the first and second inclined surfaces. The connector has a bottom side formed with a first and second coupling section connectable to the connecting portion. The connector is positionable in a first position in which one of the first and second coupling sections is releasably joined to the connecting portion of the ramp component and the other of the first and second coupling sections is adapted to releasably couple to a ramp or an external structure, and a second position in which the first and second coupling sections are releasably joined to connecting portion of the ramp component.

13 Claims, 14 Drawing Sheets

MODULAR RAMP SYSTEM

CROSS REFERENCE TO RELATED APPLICATION

The present application is a continuation-in-part application of U.S. patent application Ser. No. 15/886,941 filed on Feb. 2, 2018.

BACKGROUND OF THE INVENTION

1. Field of the Invention

The present invention relates to a ramp system and, particularly, to a modularized ramp system for extreme sports.

2. Description of the Related Art

U.S. Pat. No. 8,852,008 is a ramp system for extreme sports. The ramp system consists of two ramp components. The ramp components are connected back to back with one another in a direction of travel such that a user travels up one ramp component and then immediately down the other. The ramp system only has one configuration. Therefore, it is desirable to provide a ramp system which can allow a user to travel different directions. In addition, the ramp system has to withstand the extreme forces generated by the use of skateboards, in-line skates, scooters and bicycles while providing a smooth segment transition.

The present invention is, therefore, intended to obviate or at least alleviate the problems encountered in the prior art.

SUMMARY OF THE INVENTION

According to the present invention, a modular ramp system includes a ramp component and a connector releasably joined to the ramp component. The ramp component is made from a single piece material. The ramp component has a bottom surface, a top surface above the bottom surface at a height, a first and second inclined surface extending from opposite sides of the top surface to the bottom surface, and a connecting portion formed on the top surface and positioned between the first and second inclined surfaces. The connector has a bottom side formed with a first and second coupling section connectable to the connecting portion. The connector is positionable in a first position in which one of the first and second coupling sections is releasably joined to the connecting portion of the ramp component and the other of the first and second coupling sections is adapted to releasably couple to a ramp or an external structure, and a second position in which the first and second coupling sections are releasably joined to connecting portion of the ramp component.

Further, a modular ramp subsystem for providing a circular inclined smooth surface on which a user can travel includes at least one first ramp component made from a single piece material. The at least one first ramp component has a bottom surface, an inclined top surface, and opposite first and second lateral sides. The inclined top surface has a first height at a first end and a second height at a second end which is higher than the first height. The inclined top surface has a width extending between the first and second lateral sides and the width at the first end is smaller than the width at the second end. The first lateral side extends along a first axis and the second lateral side extends along a second axis respectively. The first axis intersects the second axis and has a first included angle therebetween, A1, which is less than 120 degrees.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a modular ramp system for extreme sports.

It is another objective of the present invention that ramp components of the modular ramp system are adapted to be assembled together in a variety of configurations and is capable of ready assembly and disassembly.

It is yet another objective of the present invention that the modular ramp system is sturdy.

Other objectives, advantages, and new features of the present invention will become apparent from the following detailed description of the invention when considered in conjunction with the accompanied drawings.

DETAILED DESCRIPTION OF THE INVENTION

Figure 1:
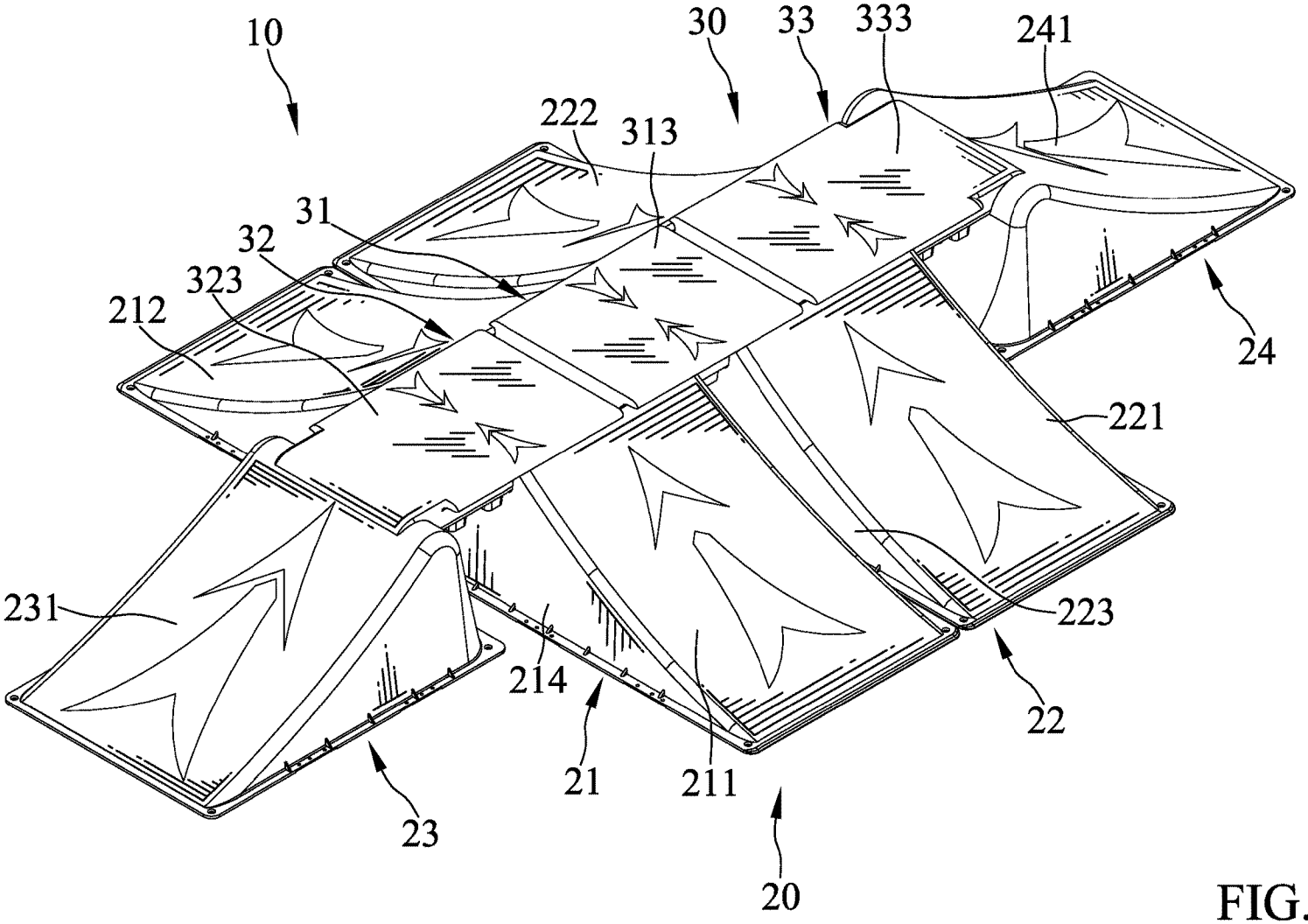
FIG. 1 is a perspective view of a modular ramp system in accordance with a first embodiment of the present invention.
Figure 2:
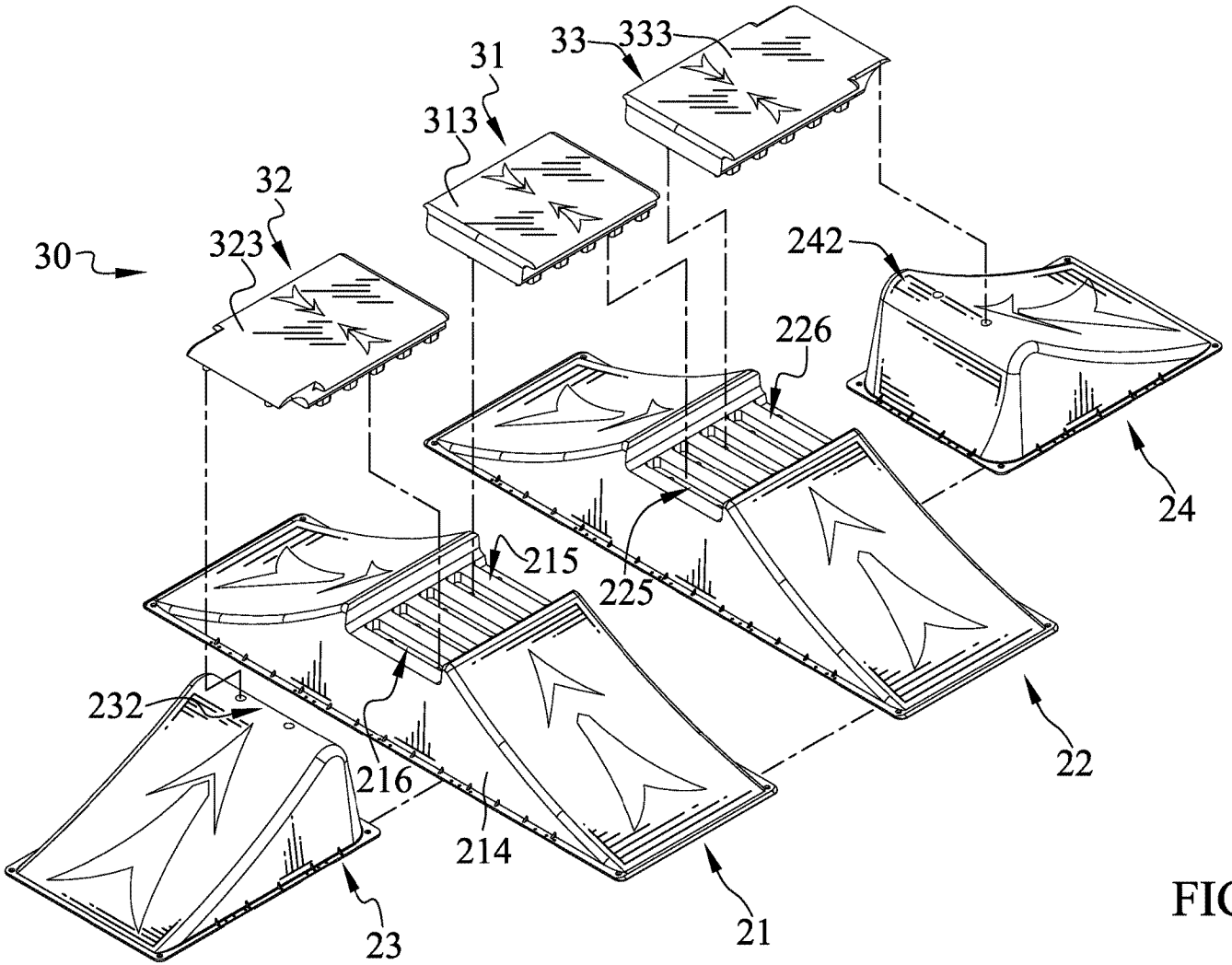
FIG. 2 is an exploded perspective view of the modular ramp system of FIG. 1.
Figure 3:
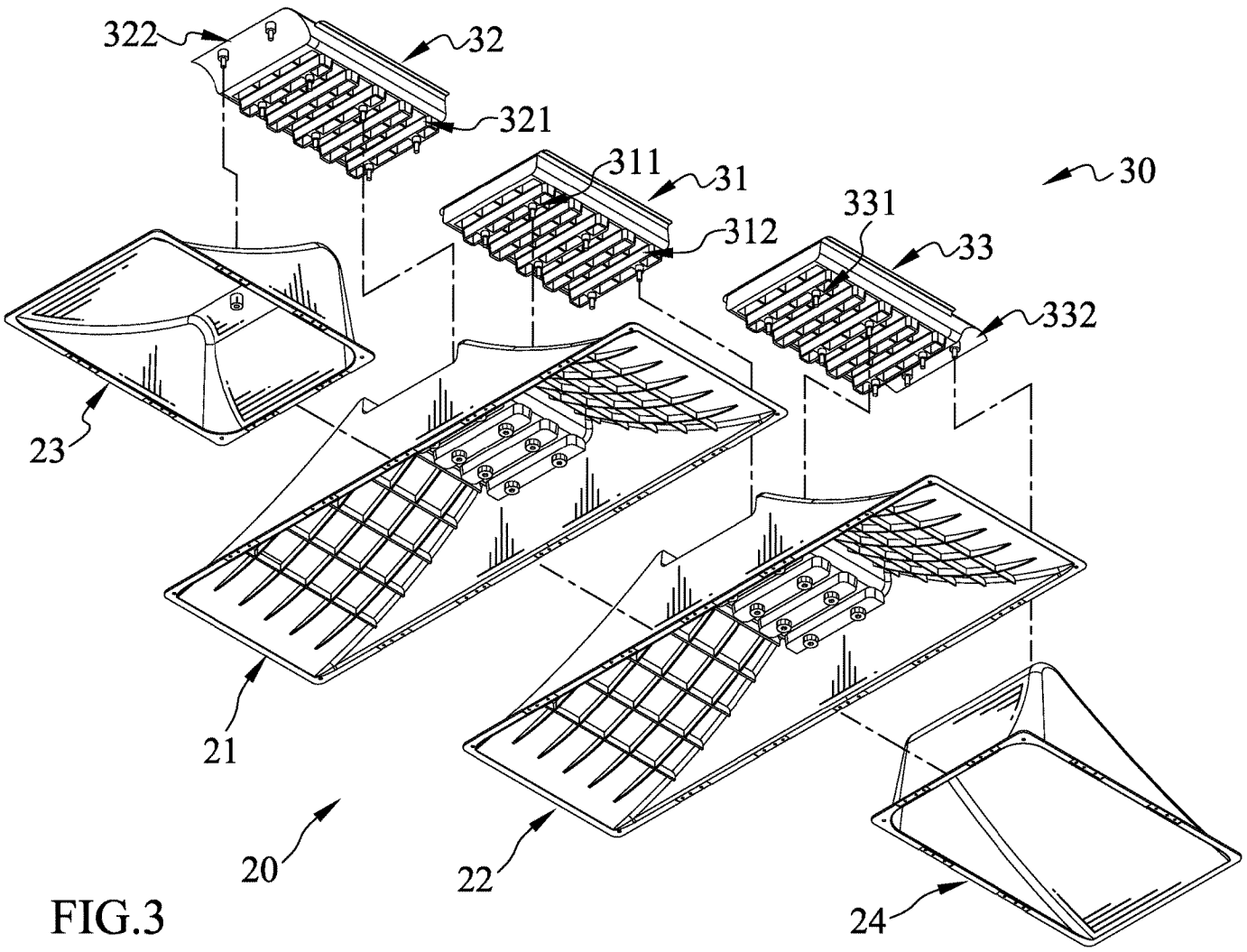
FIG. 3 is an exploded perspective view similar to FIG. 2, but taken from a different angle.
Figure 4:
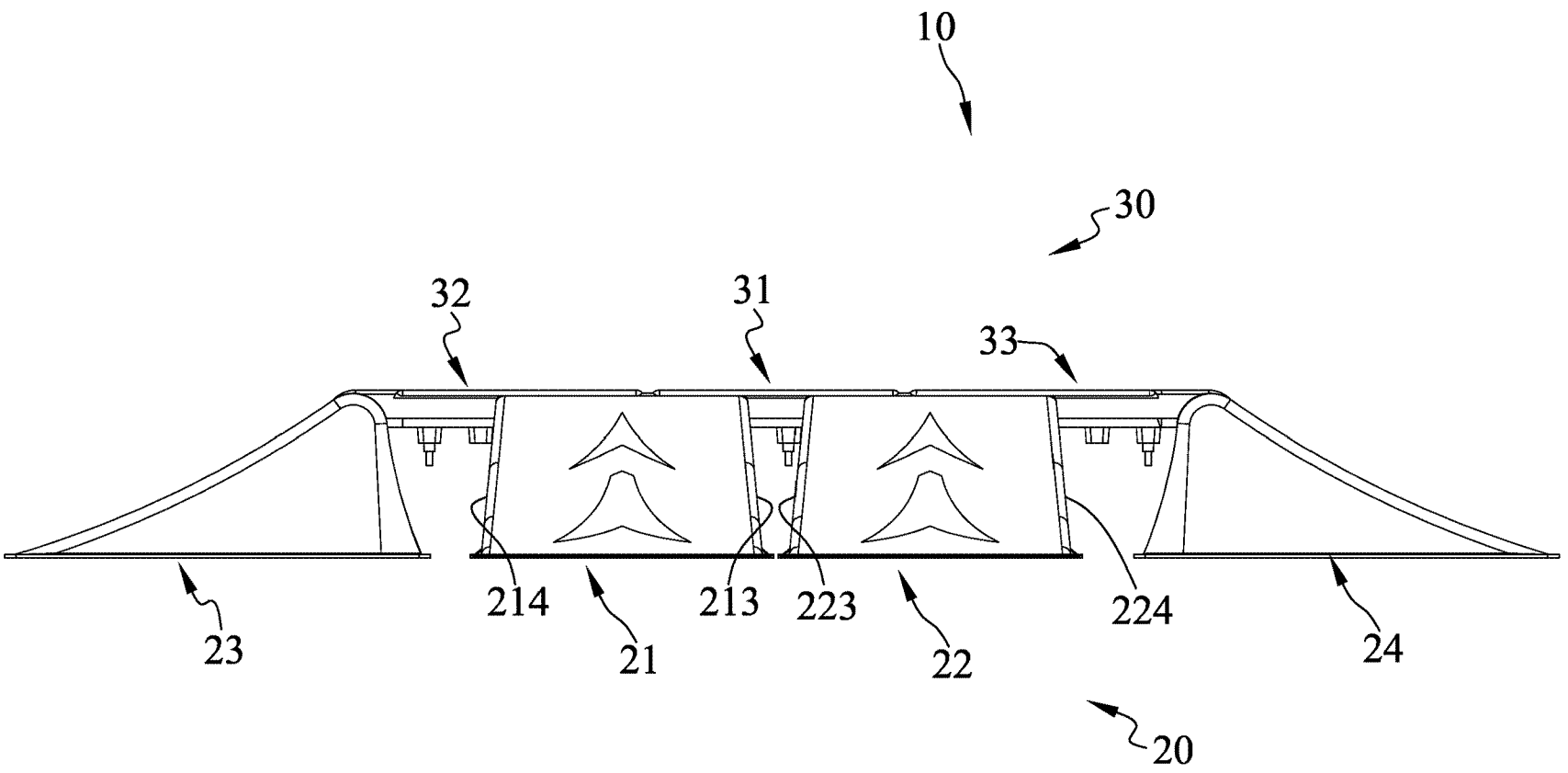
FIG. 4 is a side view of the modular ramp system of FIG. 1.

FIGS. 1 through 4 show a modular ramp system 10 of the present invention in a first configuration. The modular ramp system 10 includes ramps 20 and connectors 30.

A first ramp component 21 is made from a single piece material and has a bottom surface for resting on the ground, a top surface above the bottom surface at a height, a first and second inclined surface 211 and 212 extending from opposite sides of the top surface to the bottom surface, and a connecting portion formed on the top surface and positioned between the first and second inclined surfaces 211 and 212. The first ramp component 21 has a first lateral side 213 and a second lateral side 214 on opposite sides, and includes the top surface and the first and second inclined surfaces 211 and 212 extending between and to the first and second lateral sides 213 and 214. The connecting portion has a first connecting section 215 located adjacent to the first lateral side 213 and a second connecting section 216 located adjacent to the second lateral side 214 respectively.

A first connector 31 is releasably joined to the connecting portion of the first ramp component 21. The first connector 31 is made from a single piece of material. The first connector 31 has a bottom side formed with a coupling portion including a first and second coupling section 311 and 312 connectable to the connecting portion. The first connector 31 is positionable in a first position in which one of the first and second coupling sections 311 and 312 is releasably joined to the connecting portion of the first ramp component 21 and the other of the first and second coupling sections 311 and 312 is adapted to releasably couple to a ramp or an external structure, and a second position in which the first and second coupling sections 311 and 312 are releasably joined to connecting portion of the first ramp component 21. The first connector 31 has a planar top 313 being contiguous with and bridging the first and second inclined surfaces 211 and 212 of the first ramp component 21. The first inclined surface 211, the planar top 313, and the second inclined surface 212 cooperate to form a smooth surface on which a user can travel.

The connecting portion of the first ramp component 21 and the coupling portion of the first connector 31 are respectively provided with corresponding protruding portions and recessed portions. Each recessed portion of the connecting portion of the first ramp component 21 and each protruding portion of the coupling portion of the first connector 31 have corresponding shapes and are releasably engagable with each other. At least one protruding portion of the coupling portion of the first connector 31 is fit into one recessed portion of the connecting portion of the first ramp component 21.

The recessed portions of the connecting portion of the first ramp component 21 extend parallel to one another for easy assembly. Likewise, the protruding portions of the coupling portion of the first connector 31 extend parallel to one another. Further, at least one aperture extends into one of the recessed portions of the connecting portion of the first ramp component 21 and at least one retaining structure protrudes out from one of the protruding portions of the coupling portion of the first connector 31. The at least one retaining structure is fit in the at least one aperture.

A second ramp component 22 is releasably coupled to the first connector 31. The second ramp component 22 is made from a single piece material and has a bottom surface for resting on the ground, a top surface above the bottom surface at a height, a first and second inclined surface 221 and 222 extending from opposite sides of the top surface to the bottom surface, and a connecting portion formed on the top surface and positioned between the first and second inclined surfaces 221 and 222. The other of the first and second coupling sections 311 and 312 of the first connector 31 is releasably joined to the connecting portion of the second ramp component 22. The planar top 313 and the first and second inclined surfaces 221 and 222 of the second ramp component 22 cooperate to form a smooth surface on which a user can travel. The second ramp component 22 has a first lateral side 223 and a second lateral side 224 on opposite sides, and includes the top surface and the first and second inclined surfaces 221 and 222 extending between and to the first and second lateral sides 223 and 224. The connecting portion has a first connecting section 225 located adjacent to the first lateral side 223 and a second connecting section 226 located adjacent to the second lateral side 224 respectively. The first lateral side 223 is adjacent the first lateral side 213. The two first lateral sides 213 and 223 face oppositely. In the embodiment, the first and the second ramp components 21 and 22 are of the same shape.

The connecting portion of the second ramp component 22 and the coupling portion of the first connector 31 are respectively provided with corresponding protruding portions and recessed portions. The connecting portion of the second ramp component 22 and the coupling portion of the first connector 31 are respectively provided with corresponding recessed portions and protruding portions. Each recessed portion of the connecting portion of the second ramp component 22 and each protruding portion of the coupling portion of the second connector 32 have corresponding shapes and are releasably engagable with each other. At least one protruding portion of the coupling portion of the first connector 31 is fit into one recessed portion of the connecting portion of the second ramp component 22.

The recessed portions of the connecting portion of the second ramp component 22 extend parallel to one another for easy assembly. Further, at least one aperture extends into one of the recessed portions of the connecting portion of the second ramp component 22 and at least one retaining structure protruding out from one of the protruding portions of the coupling portion of the second connector 32. The at least one retaining structure is fit in the at least one aperture.

A third ramp component 23 is releasably coupled to the first ramp component 21 by a second connector 32. The third ramp component 23 is made from a single piece material and has a bottom surface for resting on the ground, a top surface above the bottom surface at a height, an inclined surface 231 extending from the top surface to the bottom surface, and a connecting portion 232 formed on the top surface. The second connector 32 is made from a single piece of material. The second connector 32 has a bottom side formed with a coupling portion including a first coupling section 321 releasably joined to the connecting portion of the first ramp component 21 and a second coupling section 322 releasably joined to the connecting portion 232 of the third ramp component 23 respectively. The second connector 32 has a planar top 323 bridging the inclined surface 231 of the third ramp component 23 and the planar top 313 of the first connector 31. The planar top 323 is contiguous with the inclined surface 231. The inclined surface 231 of the third ramp component 23 and the planar tops 313 and 323 of the first and second connectors 31 and 32 cooperate to form a smooth surface on which a user can travel.

The connecting portion of the first ramp component 21 and the first coupling section 321 of the second connector 32 are respectively provided with corresponding protruding portions and recessed portions. The connecting portion of the first ramp component 21 and the first coupling section 321 of the second connector 32 are respectively provided with corresponding recessed portions and protruding portions. At least one protruding portion of the first coupling section 321 of the second connector 32 is fit into one recessed portion of the connecting portion of the first ramp component 21. The connecting portion 232 of the third ramp component 23 and the second coupling section 322 of the second connector 32 are respectively provided with corresponding recessed portions and protruding portions. At least one protruding portion of the second coupling section 322 of the second connector 32 is fit into one recessed portion of the connecting portion 232 of the third ramp component 23.

A fourth ramp component 24 is releasably coupled to the second ramp component 22 by a third connector 33. The fourth ramp component 24 has a bottom surface for resting on the ground, a top surface above the bottom surface at a height, an inclined surface 241 extending from the top surface to the bottom surface, and a connecting portion 242 formed on the top surface. The third connector 33 is made from a single piece of material. The third connector 33 has a bottom side formed with a coupling portion including a first coupling section 331 releasably joined to the connecting portion of the second ramp component 22 and a second coupling section 322 releasably joined to the connecting portion 242 of the fourth ramp component 24 respectively. The third connector 33 has a planar top 333 bridging the inclined surface 241 of the fourth ramp component 24 and the planar top 313 of the first connector 31. The planar top 333 is contiguous with the inclined surface 241. The inclined surface 241 of the fourth ramp component 24 and the planar tops 313 and 333 of the first and third connectors 31 and 33 cooperate to form a smooth surface on which a user can travel.

The connecting portion 242 of the fourth ramp component 24 and the second coupling section 332 of the third connector 33 are respectively provided with corresponding recessed portions and protruding portions. At least one protruding portion of the second coupling section 332 of the third connector 33 is fit into one recessed portion of the connecting portion 242 of the fourth ramp component 24.

Figure 5:
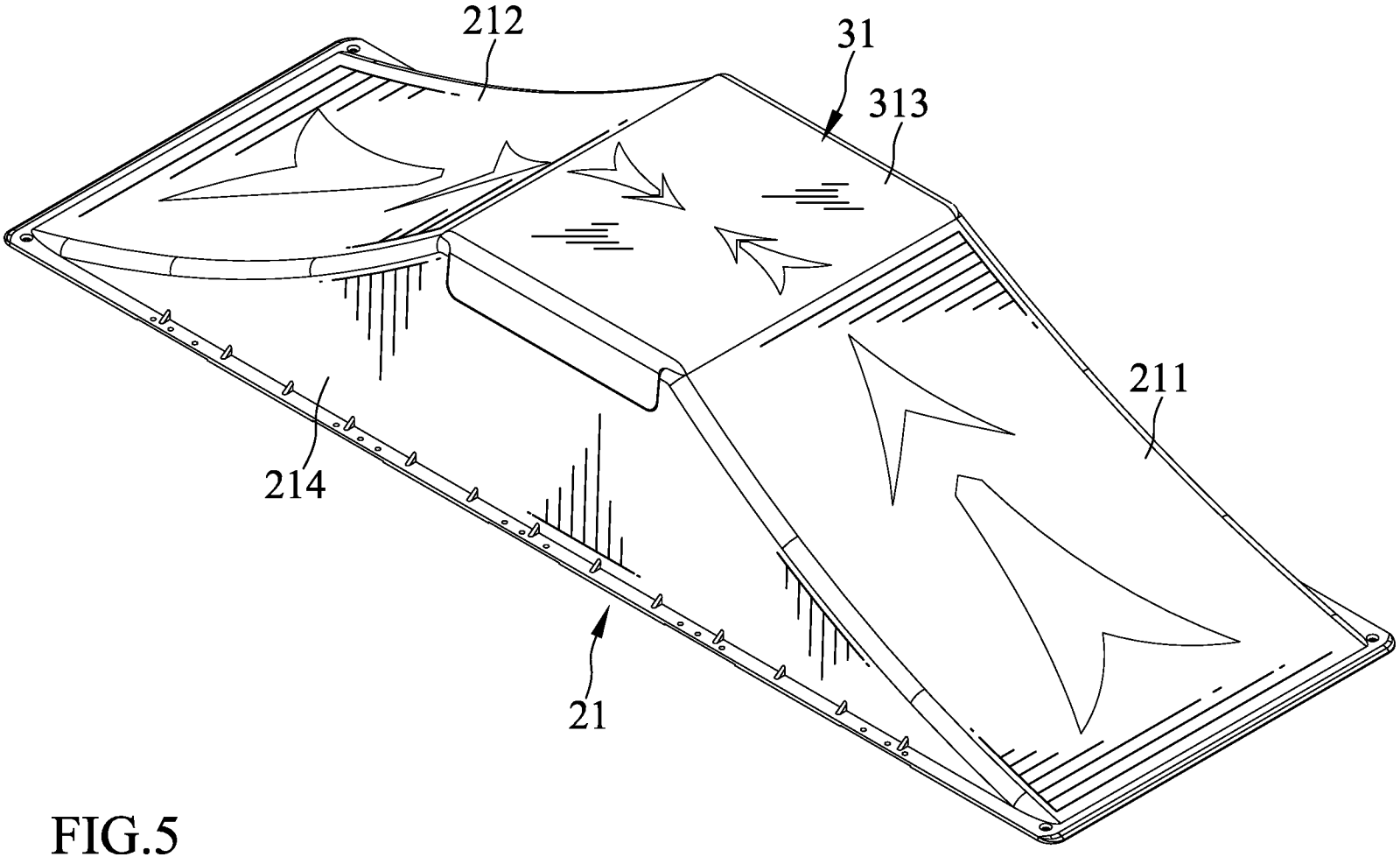
FIG. 5 is a perspective view of the modular ramp system accordance with a second embodiment of the present invention.
Figure 6:
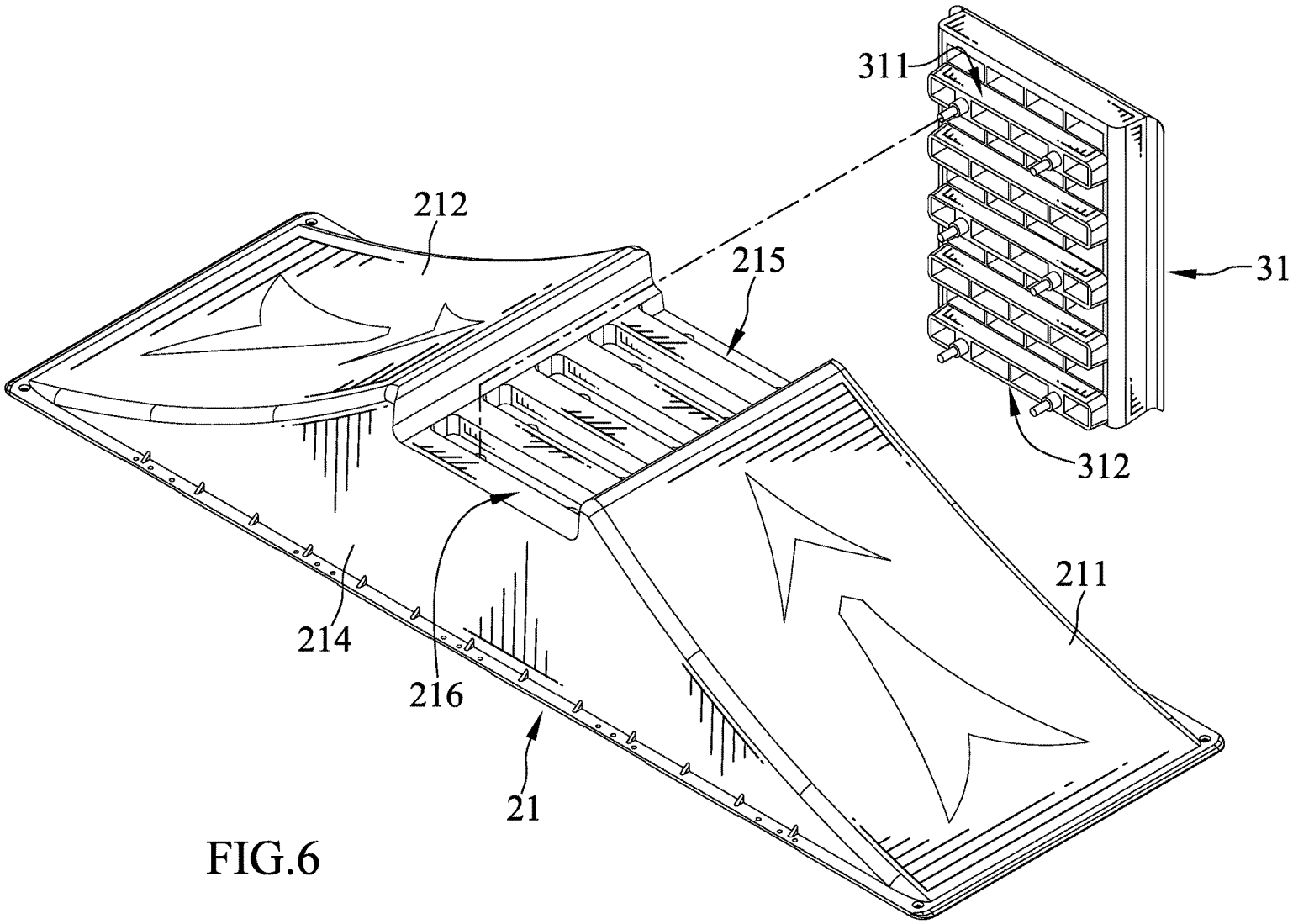
FIG. 6 is an exploded perspective view of the modular ramp system of FIG. 5.
Figure 7:
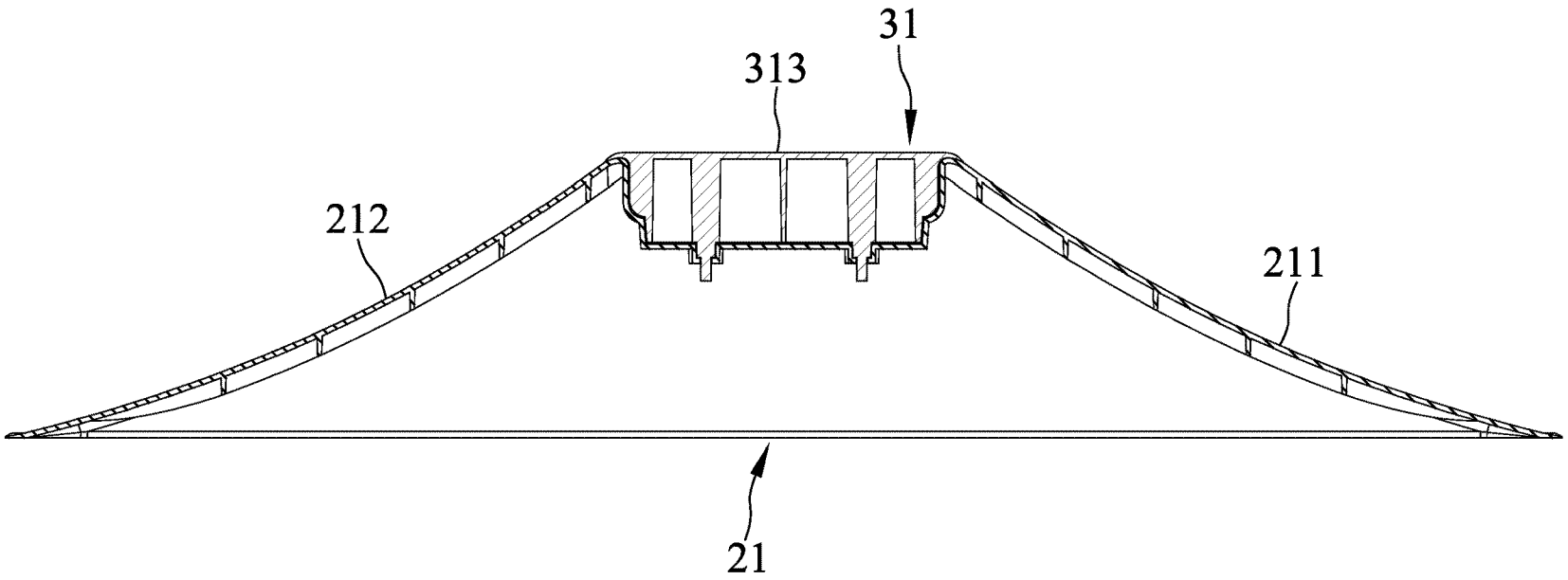
FIG. 7 is a cross-sectional view of the modular ramp shown in FIG. 5.
Figure 8:
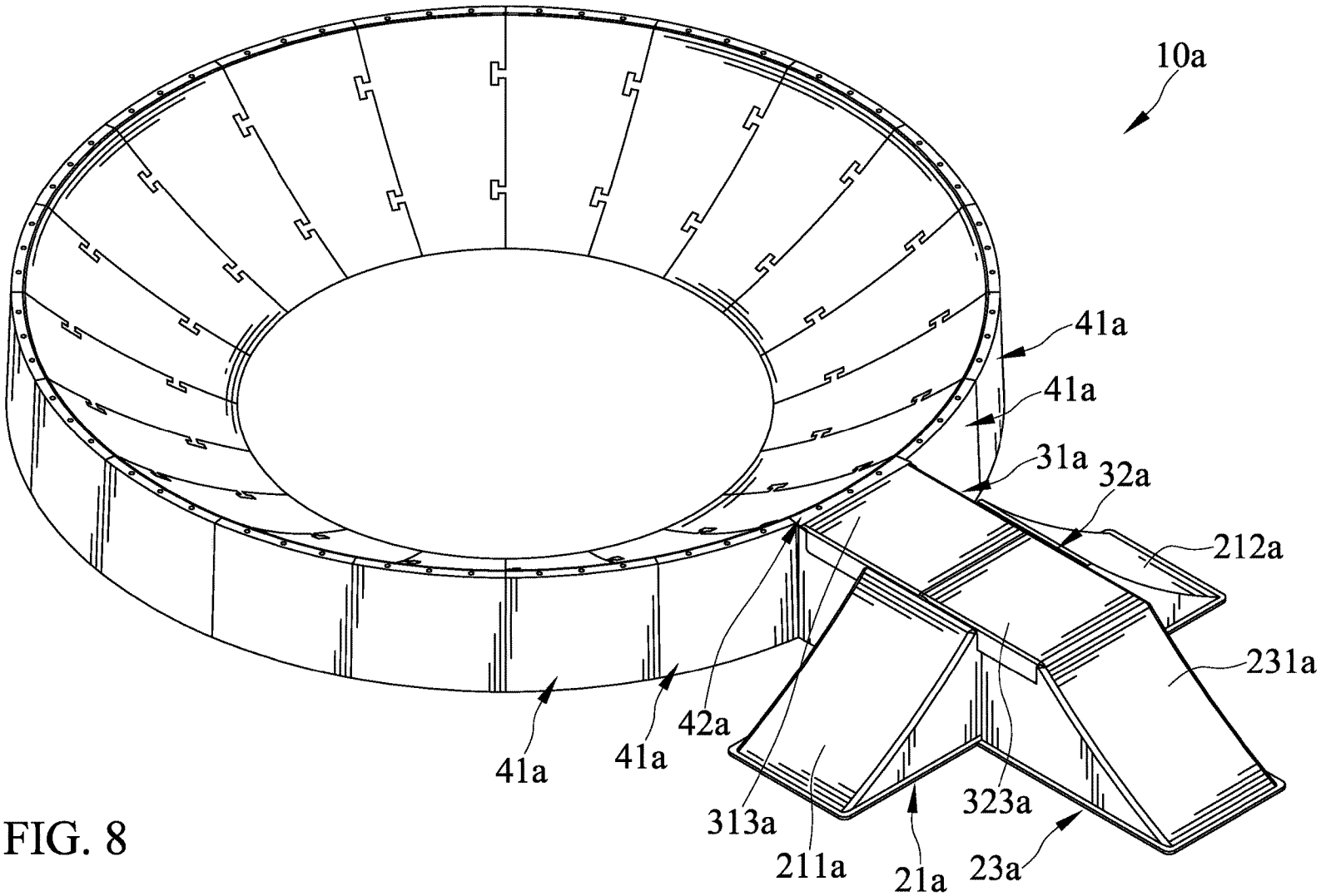
FIG. 8 is a perspective view of a modular ramp system in accordance with a third embodiment of the present invention.
Figure 9:
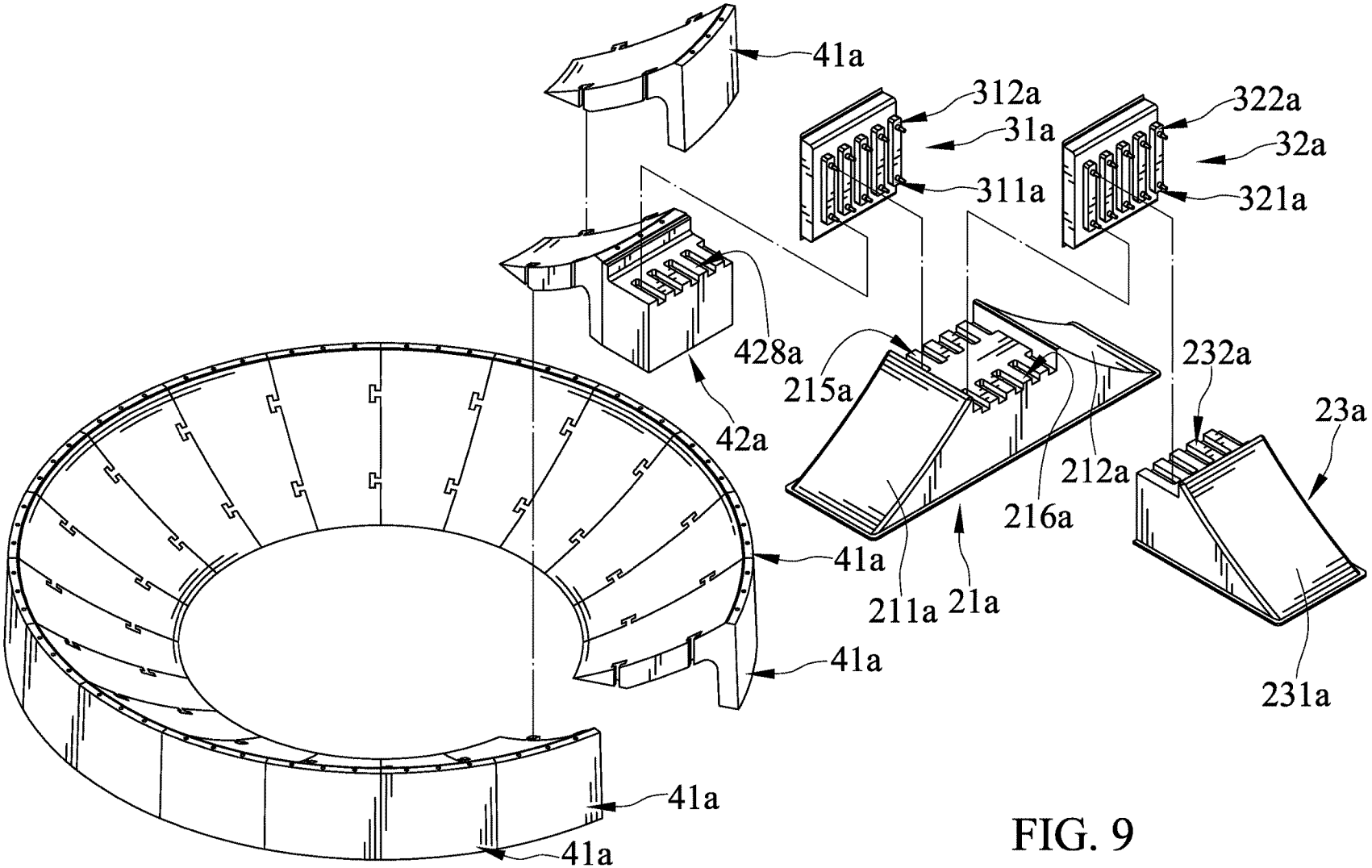
FIG. 9 is an exploded perspective view of the modular ramp system of FIG. 8.
Figure 10:
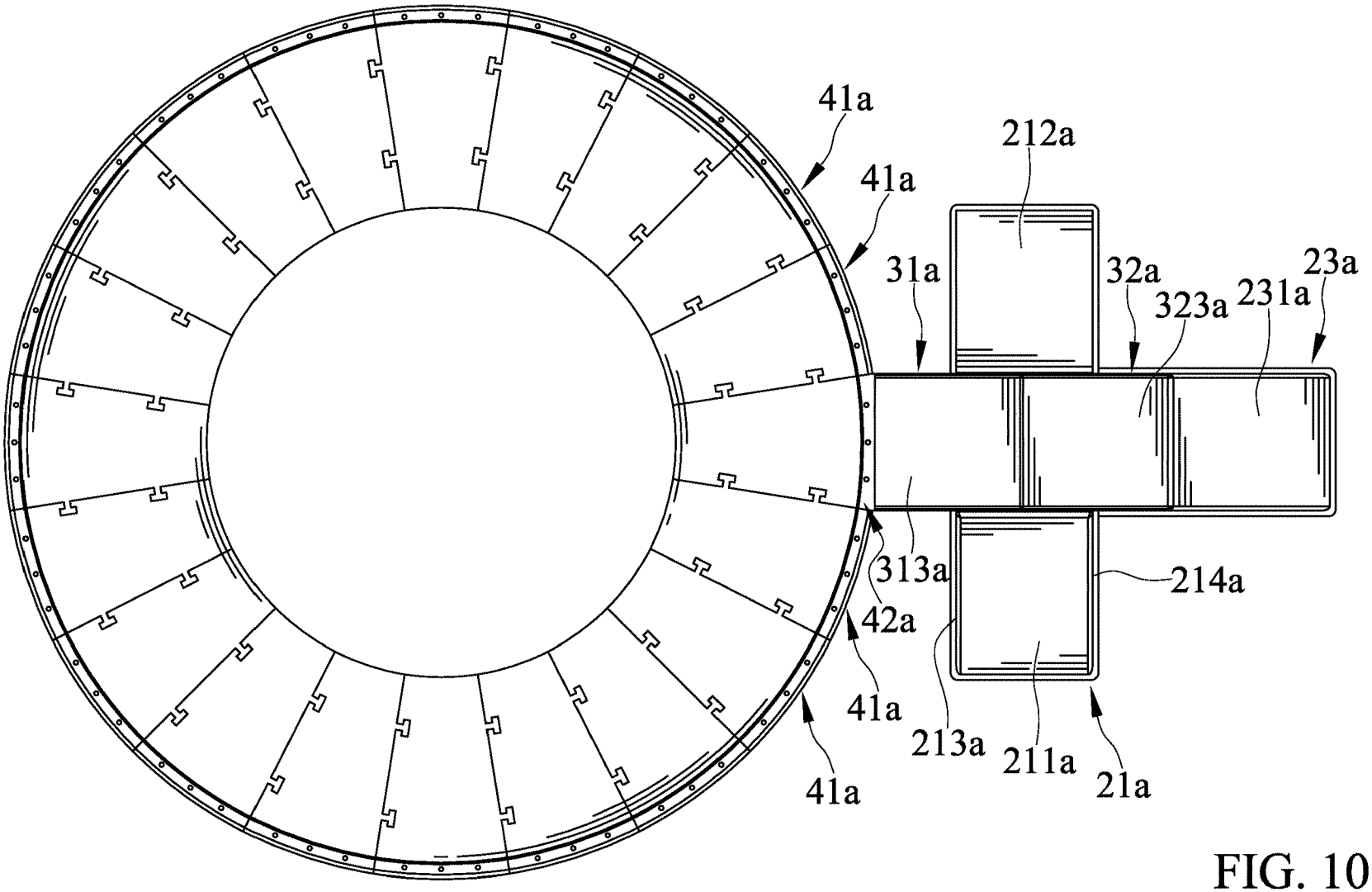
FIG. 10 is a top view of the modular ramp system of FIG. 8.
Figure 11:
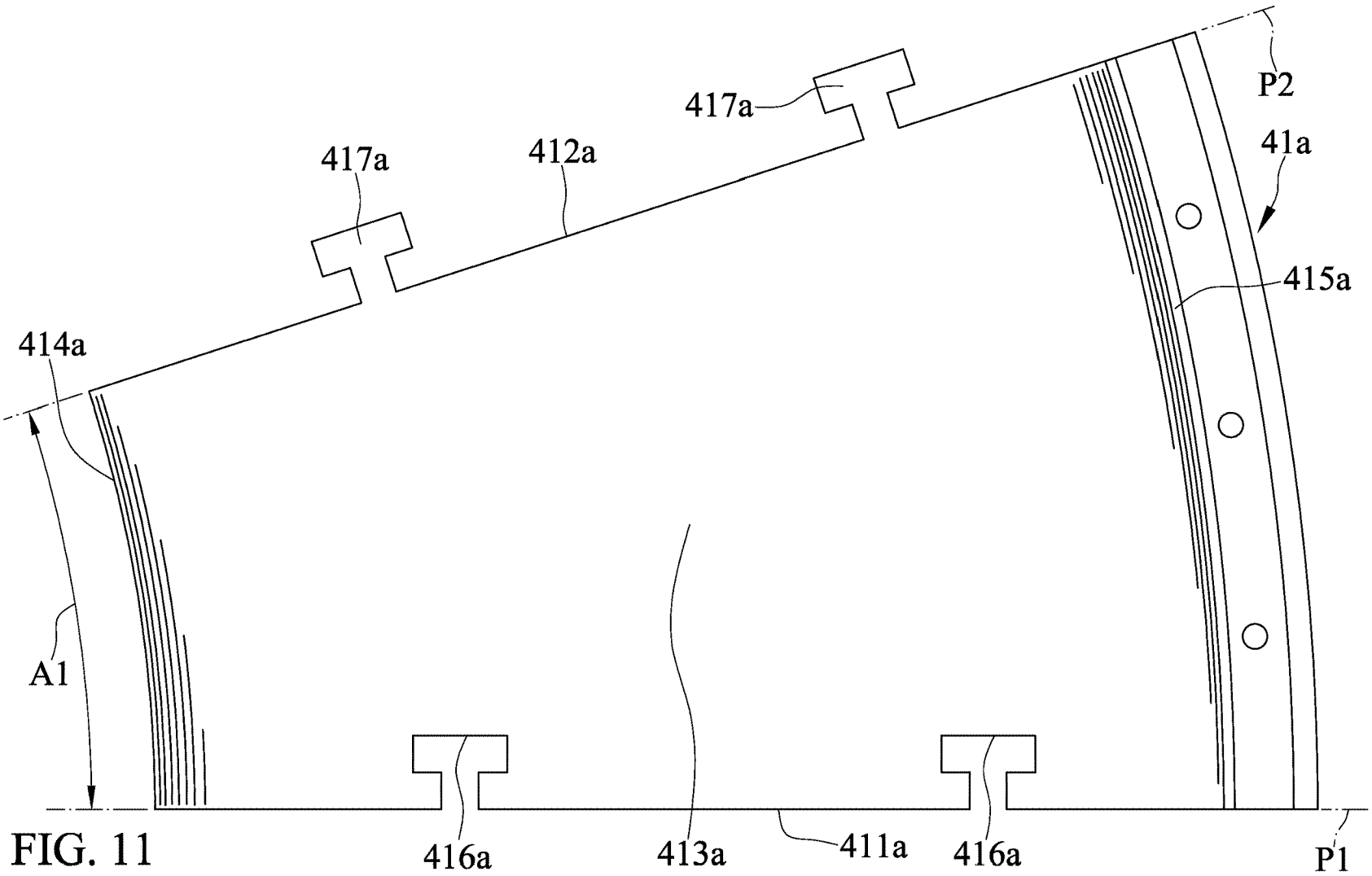
FIG. 11 is a top view of one of a plurality of first ramp components of a modular ramp subsystem of the modular ramp system of FIG. 8.
Figure 12:
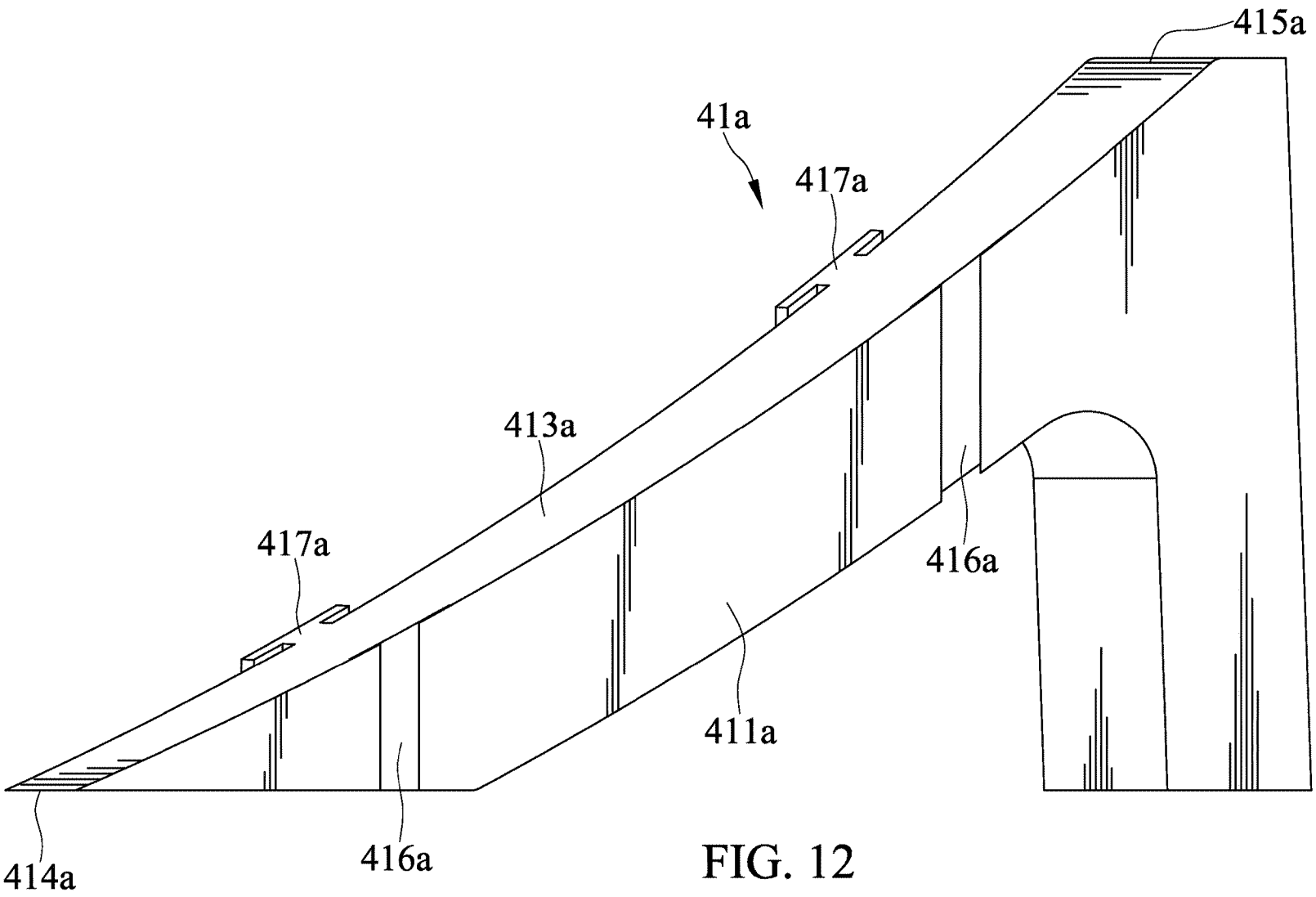
FIG. 12 is a perspective view of the first ramp component of FIG. 11.
Figure 13:
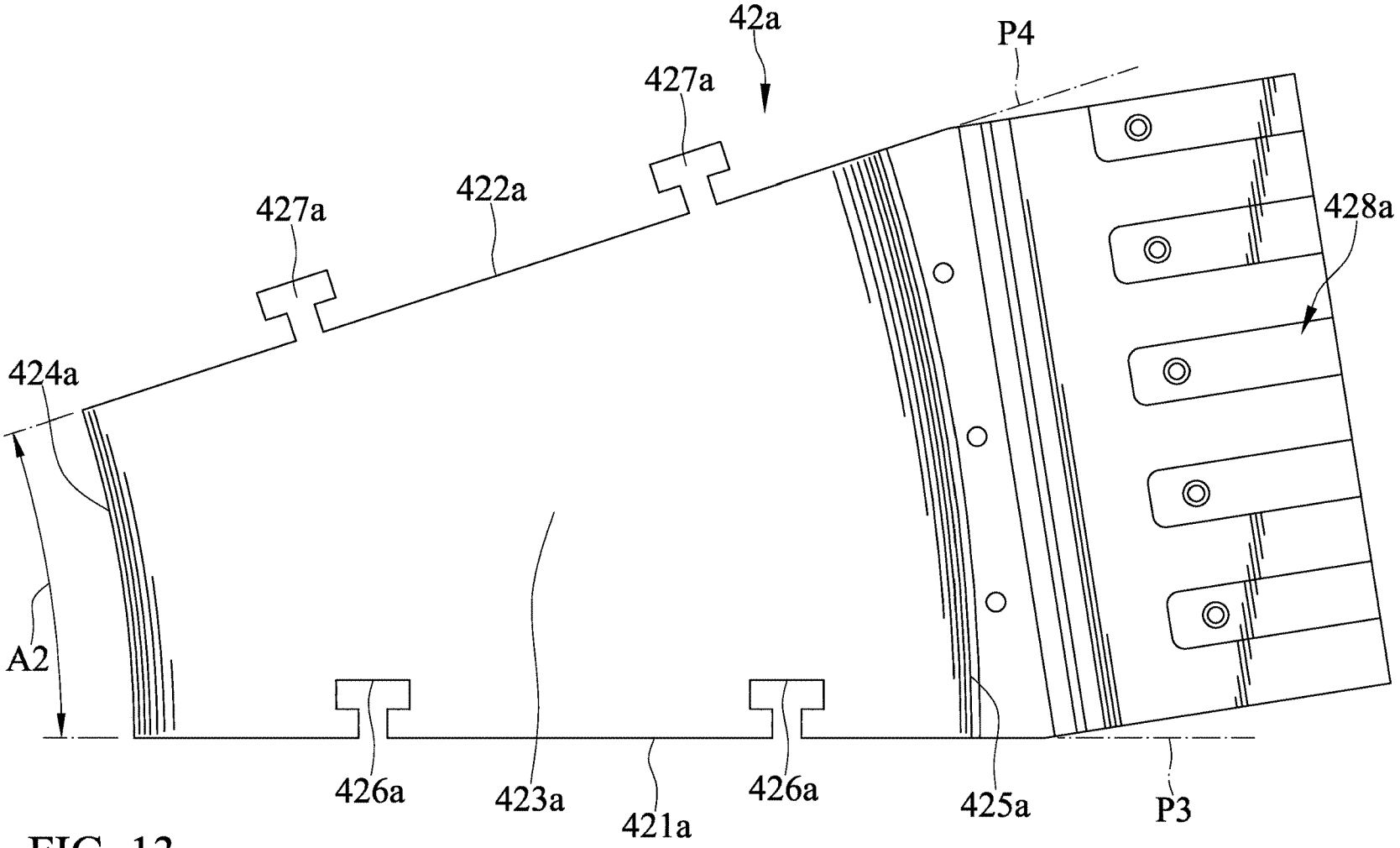
FIG. 13 is a top view of a second ramp component of the modular ramp subsystem of FIG. 8.
Figure 14:
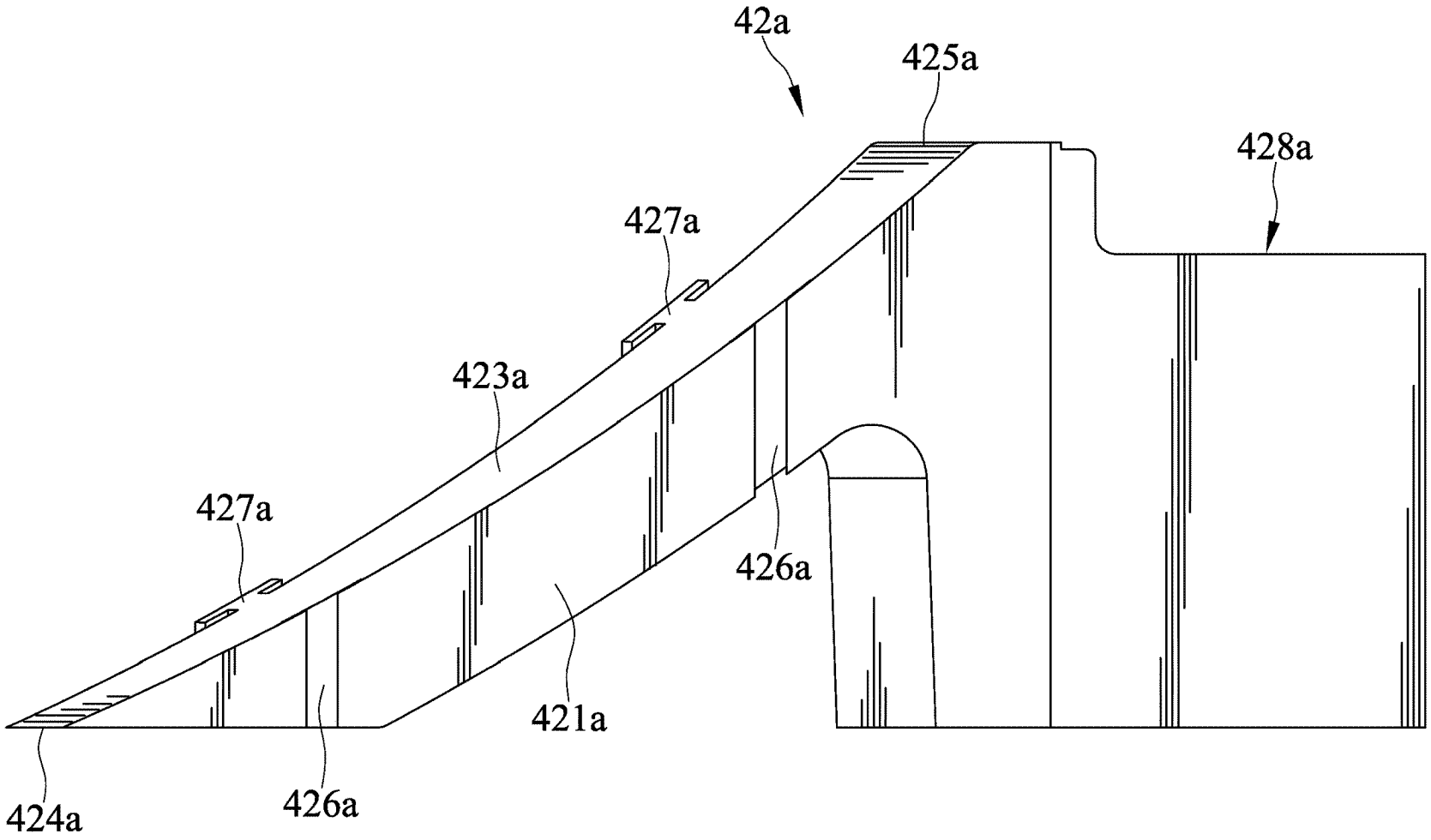
FIG. 14 is a perspective view of the second ramp component of FIG. 13.

FIGS. 5 through 7 show the modular ramp system in accordance with a second embodiment of the present invention. The second embodiment includes the first connector 31 positioned in the second position in which the first and second coupling sections 311 and 312 are releasably joined to connecting portion of the first ramp component 21.

FIGS. 9 through 14 show a modular ramp system 10*a* in accordance with a third embodiment of the present invention and the same numbers are used to correlate similar components of the first embodiment, but bearing a letter a.

A first ramp component 21*a* is made from a single piece material and has a bottom surface for resting on the ground, a top surface above the bottom surface at a height, a first and second inclined surface 211*a* and 212*a* extending from opposite sides of the top surface to the bottom surface, and a connecting portion formed on the top surface and positioned between the first and second inclined surfaces 211*a* and 212*a*. The first ramp component 21*a* has a first lateral side 213*a* and a second lateral side 214*a* on opposite sides, and includes the top surface and the first and second inclined surfaces 211*a* and 212*a* extending between and to the first and second lateral sides 213*a* and 214*a*. The connecting portion has a first connecting section 215*a* located adjacent to the first lateral side 213*a* and a second connecting section 216*a* located adjacent to the second lateral side 214*a* respectively.

A modular ramp subsystem includes a plurality of first ramp components 41*a* releasably joined with one another continuously and a second ramp component 42*a* disposed between and releasably joined to two of the plurality of the first ramp components 41*a*. Each first ramp component 41*a* is made from a single piece material and has a bottom surface for resting on the ground, an inclined top surface 413*a*, and opposite first and second lateral sides 411*a* and 412*a*. The inclined top surface 413*a* has a first height at a first end 414*a* and a second height at a second end 415*a*. The second height is higher than the first height. The inclined top surface 413*a* has a width extending between the first and second lateral sides 411 and 412*a*. The width at the first end 414*a* is smaller than the width at the second end 415*a*. The first lateral side 411*a* extends along a first axis P1. The second lateral side 412*a* extends along a second axis P2. The first axis P1 intersects the second axis P2. The first and second axes P1 and P2 have an included angle A1 therebetween. An angle of 360 degrees can be divisible by the included angle A1 with no reminder. In the embodiment, the angle A1 is 18 degrees. The included angle A1 is not greater than 120 degrees. Each first ramp component 41*a* has a first joining portion 416*a* on the first lateral sides 411*a* and a second joining portion 417*a* on the second lateral side 412*a*. The first joining portion 416*a* of one of the plurality of the first ramp components 41*a* is adapted to join to the second joining portion 417*a* of another of the first ramp components 41*a* to be engaged therewith. The first joining portion 416*a* of one of the plurality of first ramp components 41*a* and the second joining portion 417*a* of another of the plurality of first ramp components 41*a* to be engaged therewith are respectively provided with corresponding recessed portions and protruding portions. The recessed portion of the first joining portion 416*a* and the protruding portion of the second joining portion 417*a* are releasably engagable with each other and have corresponding shapes which are T shaped in cross section. At least one protruding portion of the second joining portion 417*a* is fit into one recessed portion of the first joining portion 416*a*.

The second ramp component 42*a* is made from a single piece material and has a bottom surface for resting on the ground, an inclined top surface 423*a*, and opposite first and second lateral sides 421*a* and 422*a*. The inclined top surface 423*a* has a first height at a first end 424*a* and a second height at a second end 425*a*. The second height is higher than the first height. The inclined top surface 423*a* has a width extending between the first and second lateral sides 421 and

422*a*. The width at the first end 424*a* is smaller than the width at the second end 425*a*. The first lateral side 421*a* extends along a third axis P3. The second lateral side 422*a* extends along a fourth axis P4. The third axis P3 intersects the fourth axis P4. The third and fourth axes P3 and P4 have an included angle A2 therebetween. The included angle A2 is not greater than 120 degrees. An angle of 360 degrees can be divisible by the included angle A2 with no reminder. The included angle A2 is equal to the included angle A1. The second ramp component 42*a* has a first joining portion 426*a* on the first lateral sides 421*a* and a second joining portion 427*a* on the second lateral side 422*a*. The first joining portion 426*a* of the second ramp component 42*a* is adapted to join to the second joining portion 417*a* of one of the two first ramp components 41*a* to be engaged therewith. The second joining portion 427*a* of the second ramp component 42*a* is adapted to join to the first joining portion 417*a* of the other of the two first ramp components 41*a* to be engaged therewith. The first and second joining portions 426*a* and 427*a* of the second joining portion 417*a* are respectively provided with recessed portions and protruding portions. The recessed portion of the first joining portion 426*a* and the protruding portion of the second joining portion 417*a* of one of the two first ramp components 41*a* to be engaged therewith are releasably engagable with each other and have corresponding shapes which are T shaped in cross section. The protruding portion of the second joining portion 427*a* and the recessed portion of the first joining portion 417*a* of the other of the two first ramp components 41*a* to be engaged therewith are releasably engagable with each other and have corresponding shapes which are T shaped in cross section. At least one protruding portion of the second joining portion 417*a* of one of the two first ramp components 41*a* is fit into the recessed portion of the first joining portion 417*a*. At least one protruding portion of the second joining portion 427*a* is fit into one recessed portion of the first joining portion 416*a* of the other of the two first ramp components 41*a*.

When the plurality of first ramp components 41*a* are joined, the inclined top surfaces 413*a* cooperate to form a circular smooth surface on which a user can travel. Further, when the second ramp component 42*a* is joined to the plurality of first ramp components 41*a*, the inclined top surface 423*a* and the inclined top surfaces 413*a* cooperate to form a full circular smooth surface on which a user can travel.

The second ramp component 42*a* is releasably coupled to the first ramp component 21*a* by a first connector 31*a*. The first connector 31*a* is made from a single piece of material. The first connector 31*a* has a bottom side formed with a coupling portion including a first coupling section 311*a* releasably joined to a connecting portion 428*a* of the second ramp component 42*a* and a second coupling section 322*a* releasably joined to the first connecting section 215*a* of the first ramp component 21*a* respectively. The first connector 31*a* has a planar top 313*a* bridging the inclined top surface 423*a* and the first and second inclined surfaces 211*a* and 212*a* of the first ramp component 21*a*.

A second ramp component 23*a* is releasably coupled to the first ramp component 21*a* by a second connector 32*a*. The second ramp component 23*a* is made from a single piece material and has a bottom surface for resting on the ground, a top surface above the bottom surface at a height, an inclined surface 231*a* extending from the top surface to the bottom surface, and a connecting portion 232*a*. The second connector 32*a* is made from a single piece of material. The second connector 32*a* has a bottom side formed with a coupling portion including a first coupling section 321*a* releasably joined to the second connecting section 216*a* of the first ramp component 21*a* and a second coupling section 322*a* releasably joined to the connecting portion 232*a* of the second ramp component 23*a* respectively. The second connector 32*a* has a planar top 323*a* bridging the inclined surface 231*a* and the first and second inclined surfaces 211*a* and 212*a* of the first ramp component 21*a*.

The connecting portion of the first ramp component 21*a* and the coupling portion of the first connector 31*a* are respectively provided with corresponding recessed portions and protruding portions. Each recessed portion of the connecting portion of the first ramp component 21*a* and each protruding portion of the coupling portion of the first connector 31*a* have corresponding shapes and are releasably engagable with each other. At least one protruding portion of the coupling portion of the first connector 31*a* is fit into one recessed portion of the connecting portion of the first ramp component 21*a*.

The recessed portions of the connecting portion of the first ramp component 21*a* extend parallel to one another. Likewise, the protruding portions of the coupling portion of the first connector 31*a* extend parallel to one another. Further, at least one aperture extends into one of the recessed portions of the connecting portion of the first ramp component 21 and at least one retaining structure protrudes out from one of the protruding portions of the coupling portion of the first connector 31. The at least one retaining structure is fit in the at least one aperture.

In view of the forgoing, the ramp components and the connectors set forth can be releasably coupled together to create the first, second and third modular ramp systems which have different configurations. Furthermore, the modular ramp system provides smooth surfaces for the user to travel and the ramp components set forth can snugly fit with one another to withstand extreme forces of extreme sports.

The foregoing is merely illustrative of the principles of this invention, and various modifications can be made by those skilled in the art without departing from the scope and spirit of the invention.

What is claimed is:

1. A modular ramp system for providing a circular inclined smooth surface and a surface cooperating with the circular inclined surface on which a user can travel, comprising:

at least one first ramp component made from a single piece material, wherein the at least one first ramp component has a bottom surface, an inclined top surface, and opposite first and second lateral sides, wherein the inclined top surface has a first height at a first end and a second height at a second end which is higher than the first height, wherein the inclined top surface has a width extending between the first and second lateral sides and the width at the first end is smaller than the width at the second end, wherein the first and second lateral sides extend along first and second axes respectively, wherein the first axis intersects the second axis and the first axis and the second axis have a first included angle therebetween, and wherein the first included angle is less than 120 degrees;

a second ramp component releasably joined to the at least one first ramp component, wherein the second ramp component is made from a single piece material and has a bottom surface, an inclined top surface, and opposite first and second lateral sides, wherein the inclined top surface of the second ramp component has a first height at a first end and a second height at a second end which is higher than the first height, wherein the inclined top surface of the second ramp component has a width extending between the first and second lateral sides, wherein the width at the first end of the second ramp component is smaller than the width at the second end of the second ramp component, wherein the first and second lateral sides of the second ramp component extend along third and fourth axes respectively, wherein the third axis intersects the fourth axis and the first and the second axes have a second included angle therebetween, wherein the second included angle is less than 120 degrees, and wherein when the second ramp component is joined to the at least one first ramp component, the inclined top surface thereof and the inclined top surface of the at least one first ramp component cooperate to form a portion of the circular inclined smooth surface on which the user can travel; and a third ramp component being releasably joined to the second end of the second ramp component, wherein the third ramp component forms a surface cooperating with the inclined smooth surface, and wherein the inclined top surface of the second ramp component and the surface of the third ramp component are interconnected.

2. The modular ramp system as claimed in claim 1, wherein an angle of 360 degrees is divisible by the first included angle with no reminder.

3. The modular ramp system as claimed in claim 2, wherein the first included angle is 18 degrees.

4. The modular ramp system as claimed in claim 1, wherein the at least one first ramp component has a first joining portion on the first lateral sides and a second joining portion on the second lateral side, wherein the at least one first ramp component includes a plurality of the first ramp components releasably joined with one another continuously, wherein when the plurality of first ramp components are joined, the inclined top surfaces thereof and the inclined top surface of the second ramp component cooperate to form the circular inclined smooth surface on which the user can travel, wherein the first joining portion of one of the plurality of the first ramp components is adapted to join to the second joining portion of another of the first ramp components to be engaged therewith, and wherein the first joining portion of one of the plurality of first ramp components and the second joining portion of another of the plurality of first ramp components to be engaged therewith are respectively provided with corresponding recessed portions and protruding portions which are releasably engagable with each other and have corresponding shapes.

5. The modular ramp system as claimed in claim 4, wherein the shapes of the protruding and recessed portions are T shaped in cross section.

6. The modular ramp system as claimed in claim 2, wherein an angle of 360 degrees is divisible by the second included angle with no remainder.

7. The modular ramp system as claimed in claim 6, wherein the second included angle is equal to the first included angle.

8. The modular ramp system as claimed in claim 7, wherein the first included angle is 18 degrees.

9. The modular ramp system as claimed in claim 4, wherein the second ramp component has a first joining portion on the first lateral sides and a second joining portion on the second lateral side, wherein the first joining portion of the second ramp component is adapted to join to the second joining portion of one of the two first ramp components to be engaged therewith, wherein the second joining portion of the second ramp component is adapted to join to the first joining portion of the other of the two first ramp components to be engaged therewith, wherein the first and second joining portions of the second ramp component are respectively provided with recessed portions and protruding portions, wherein the recessed portion of the first joining portion of the second ramp component and the protruding portion of the second joining portion of one of the two first ramp components to be engaged therewith have corresponding shapes, and wherein the protruding portion of the second joining portion of the second ramp component and the recessed portion of the first joining portion of the other of the two first ramp components to be engaged therewith have corresponding shapes.

10. The modular ramp system as claimed in claim 9, wherein the shapes of the protruding and recessed portions of the second ramp component are T shaped in cross section.

11. A modular ramp system for providing a circular inclined smooth surface on which a user can travel, comprising:

at least one first ramp component made from a single piece material, wherein the at least one first ramp component has a bottom surface, an inclined top surface, and opposite first and second lateral sides, wherein the inclined top surface has a first height at a first end and a second height at a second end which is higher than the first height, wherein the inclined top surface has a width extending between the first and second lateral sides and the width at the first end is smaller than the width at the second end, wherein the first and second lateral sides extend along first and second axes respectively, wherein the first axis intersects the second axis, and the first and the second axes have a first included angle therebetween, and wherein the first included angle is less than 120 degrees, wherein the at least one first ramp component has a first joining portion on the first lateral sides and a second joining portion on the second lateral side, wherein the at least one first ramp component includes a plurality of the first ramp components releasably joined with one another continuously, wherein when the plurality of first ramp components are joined, the inclined top surfaces thereof cooperate to form a portion of the circular smooth surface on which the user can travel, wherein the first joining portion of one of the plurality of the first ramp components is adapted to join to the second joining portion of another of the first ramp components to be engaged therewith, and wherein the first joining portion of one of the plurality of first ramp components and the second joining portion of another of the plurality of first ramp components to be engaged therewith are respectively provided with corresponding recessed portions and protruding portions which are releasably engagable with each other and have corresponding shapes;

a second ramp component disposed between and releasably joined to two of the plurality of the first ramp components, wherein the second ramp component is made from a single piece material and has a bottom surface, an inclined top surface, and opposite first and second lateral sides, wherein the inclined top surface of the second ramp component has a first height at a first end and a second height at a second end which is higher than the first height, wherein the inclined top surface of the second ramp component has a width extending between the first and second lateral sides, wherein the width at the first end of the second ramp component is smaller than the width at the second end of the second ramp component, wherein the first and second lateral sides of the second ramp component extend along third and fourth axes respectively, wherein the third axis intersects the fourth axis and have a second included angle therebetween, wherein the second included angle is less than 120 degrees, and wherein when the second ramp component is joined to the plurality of first ramp components, the inclined top surface thereof and the inclined top surfaces of the plurality of the first ramp components cooperate to form a full circular smooth surface on which a user can travel; and a third ramp component releasably joined to the second ramp component by a first connector, wherein the third ramp component is made from a single piece material and having a bottom surface, a top surface above the bottom surface at a height, a first and second inclined surface extending from opposite sides of the top surface to the bottom surface, and a connecting portion formed on the top surface and positioned between the first and second inclined surfaces, wherein the connecting portion has a first connecting section located adjacent to the first lateral side and a second connecting section located adjacent to the second lateral side respectively, wherein the first connector is made from a single piece of material, wherein the first connector has a bottom side formed with a coupling portion including a first coupling section releasably joined to a connecting portion of the second ramp component and a second coupling section releasably joined to the first connecting section of the third ramp component respectively, and wherein the first connector has a planar top bridging the inclined top surface of the second ramp component and the first and second inclined surfaces of the third ramp component.

12. The modular ramp system as claimed in claim 11 further comprising a fourth ramp component releasably joined to the third ramp component by a second connector, wherein the fourth ramp component is made from a single piece material and has a bottom surface, a top surface above the bottom surface at a height, an inclined surface extending from the top surface to the bottom surface, and a connecting portion, wherein the second connector is made from a single piece of material, wherein the second connector has a bottom side formed with a coupling portion including a first coupling section releasably joined to the second connecting section of the third ramp component and a second coupling section releasably joined to the connecting portion of the fourth ramp component respectively, and wherein the second connector has a planar top bridging the inclined surface of the fourth ramp component and the first and second inclined surfaces of the third ramp component.

13. The modular ramp system as claimed in claim 12, wherein the connecting portion of the third ramp component and the coupling portion of the first connector are respectively provided with corresponding recessed portions and protruding portions, wherein each recessed portion of the connecting portion of the third ramp component and each protruding portion of the coupling portion of the first connector have corresponding shapes.

* * * * *